US007311588B1

(12) United States Patent
Lin

(10) Patent No.: US 7,311,588 B1
(45) Date of Patent: Dec. 25, 2007

(54) WATER GRINDER

(75) Inventor: Freddy Lin, Taichung Hsien (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 11/514,362

(22) Filed: Sep. 1, 2006

(51) Int. Cl.
*B24B 27/08* (2006.01)
*B24B 55/02* (2006.01)

(52) U.S. Cl. ..... 451/359; 451/449; 451/450

(58) Field of Classification Search ..... 451/358, 451/449, 450
See application file for complete search history.

(56) References Cited

U.S. PATENT DOCUMENTS 1,971,790 A * 8/1934 Mall ..... 451/359
2,568,096 A * 9/1951 Stewart ..... 451/28
2,626,493 A * 1/1953 Speicher ..... 451/450
2,733,562 A * 2/1956 Drummond ..... 451/450
4,102,084 A * 7/1978 Bloomquist ..... 451/357
4,129,966 A * 12/1978 Smart et al. ..... 451/359
4,216,630 A * 8/1980 Smart et al. ..... 451/359
4,523,411 A * 6/1985 Freerks ..... 451/357
5,597,348 A * 1/1997 Hutchins ..... 451/450
5,839,948 A * 11/1998 Kronberg ..... 451/353
6,595,196 B2 * 7/2003 Bath ..... 125/13.01
7,189,154 B1 * 3/2007 Karppinen et al. ..... 451/449
2006/0229005 A1 * 10/2006 Gautier et al. ..... 451/359

* cited by examiner

*Primary Examiner*—M. Rachuba
(74) *Attorney, Agent, or Firm*—Troxell Law Office, PLLC

(57) ABSTRACT

A water grinder including: a housing in which a rotary shaft is drivably disposed, the rotary shaft being formed with an axial passage; a water incoming flow way formed in the housing; a valve disposed in the housing and controllable by a selection switch; an external water discharging assembly disposed at a front end of the housing and having at least one water outlet; and a water flow bypass communicating with the external water discharging assembly and the valve. By means of turning the selection switch, the valve can be turned to a position to conduct the water from the flow way into the passage of the rotary shaft to discharge therefrom. Alternatively, the valve can be turned to another position to conduct the water to flow into the external water discharging assembly to discharge from the water outlet. Accordingly, the water discharging position is controllable to achieve best wetting effect for the powder dust produced in grinding operation.

17 Claims, 9 Drawing Sheets

WATER GRINDER

BACKGROUND OF THE INVENTION

The present invention is related to a grinding device, and more particularly to a handheld grinder equipped with a water discharging unit. The water incoming mechanism of the grinder is disposed in the housing of the grinder. In addition, the water discharging position of the grinder is adjustable.

When grinding a work piece with a handheld grinder, much powder dust is produced. The conventional grinder is designed with a water discharging unit for wetting the powder dust and avoiding flight thereof. A metal water pipe is added to the housing of the grinder for conducting the water to a grinding position. Such grinder with the water discharging unit is so-called "water grinder".

In the conventional water grinder, the water pipe is externally added to the housing and exposed to outer side thereof. In use, the water pipe tends to be collided and broken to lead to leakage of the water.

Moreover, the water discharging position of the conventional handheld water grinder is fixed and unchangeable. Therefore, the wetting effect is limited and the wetting position cannot be adjustable in accordance with different grinding conditions.

SUMMARY OF THE INVENTION

It is therefore a primary object of the present invention to provide a water grinder having a water incoming mechanism disposed in the housing of the grinder. Therefore, the water incoming mechanism is protected from being collided and broken.

It is a further object of the present invention to provide a water grinder in which the water discharging position is changeable.

The present invention can be best understood through the following description and accompanying drawings wherein:

DETAILED DESCRIPTION OF THE PREFERRED EMBODIMENTS

Figure 1:
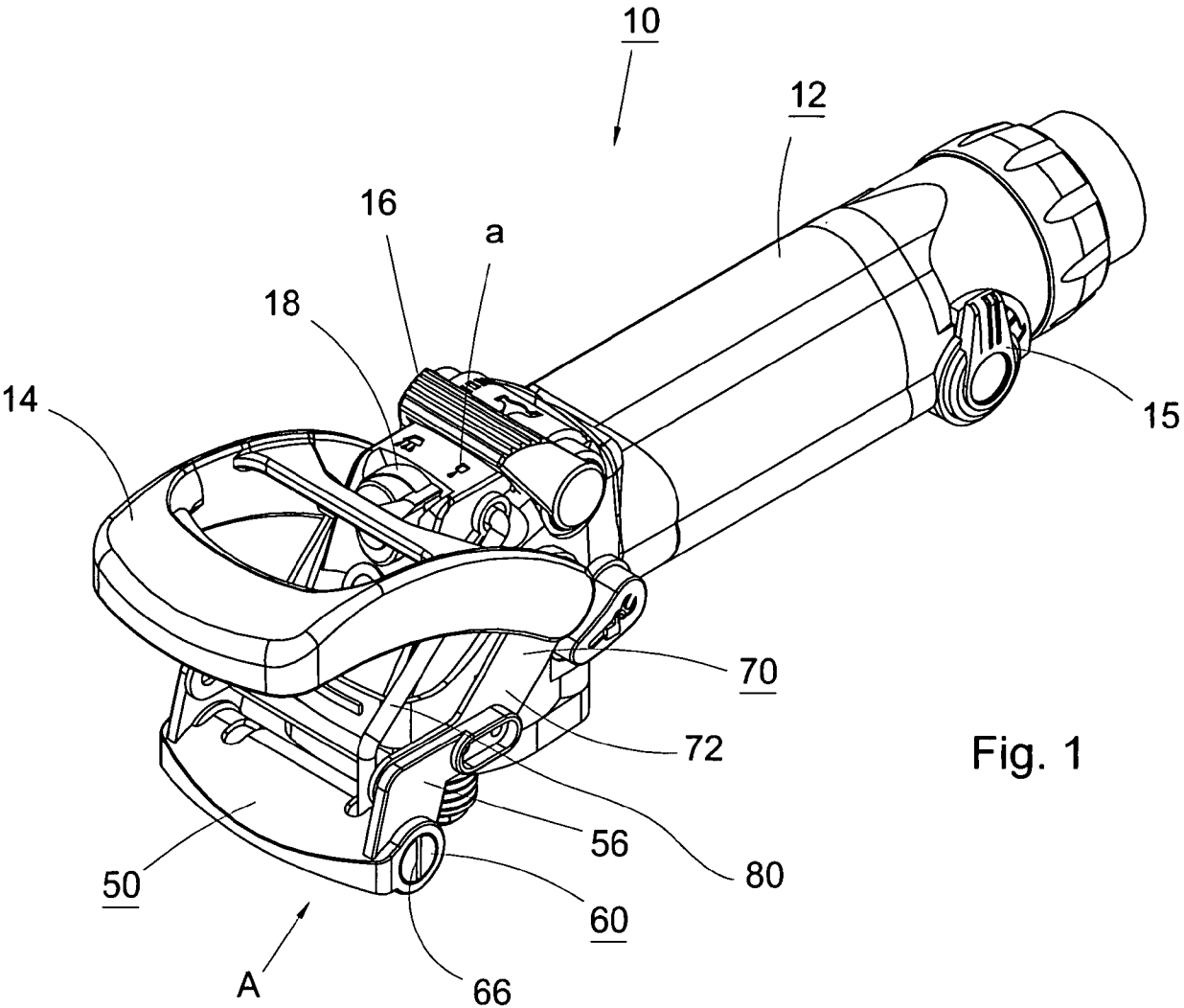
FIG. 1 is a perspective view of a first embodiment of the present invention.
Figure 2:
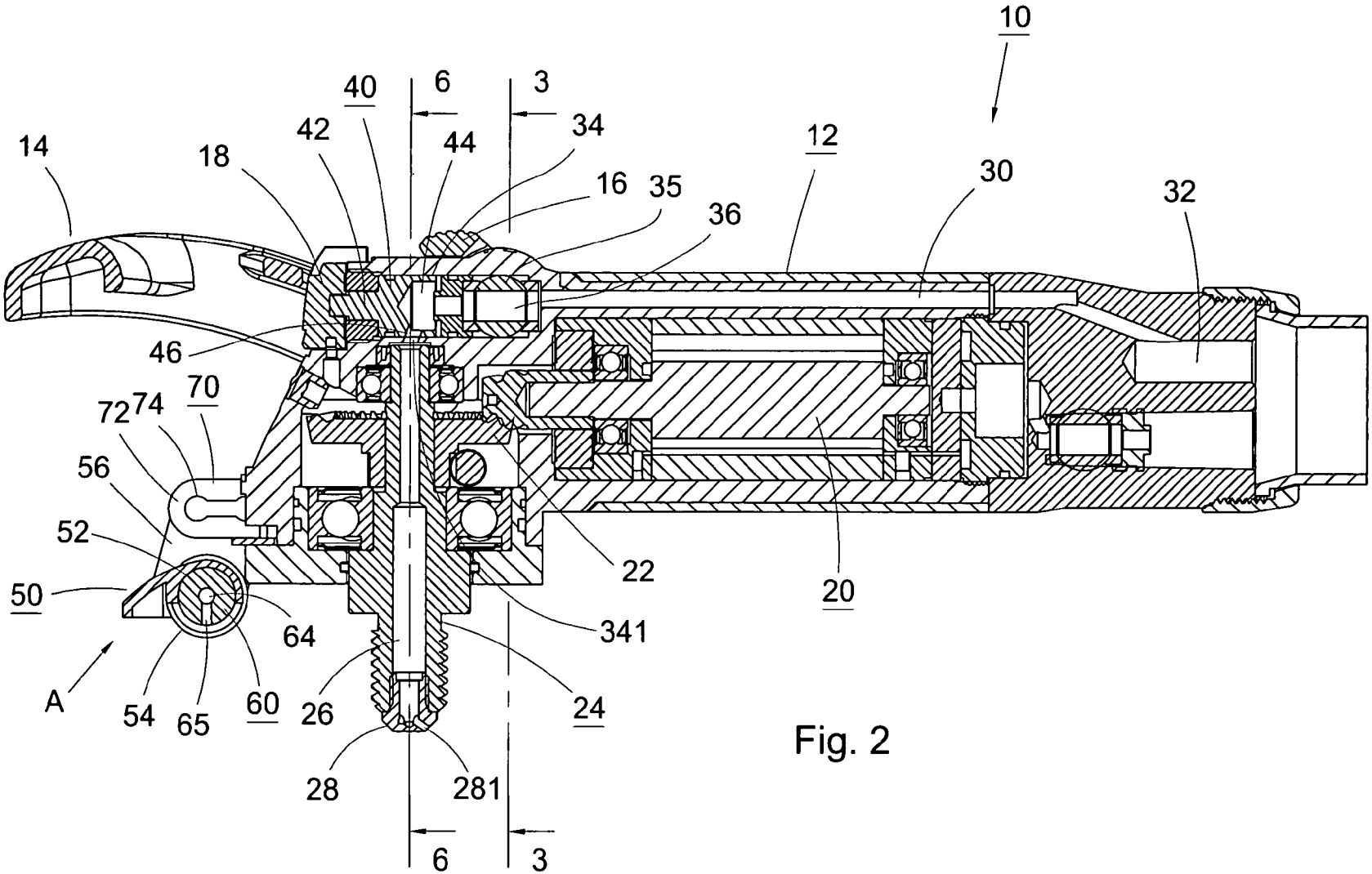
FIG. 2 is a longitudinal sectional view according to FIG. 1.

Please refer to FIG. 1. The water grinder 10 of the present invention has a housing 12 and a handle 14 arranged at front end of the housing 12. An activation switch 15, a water discharging switch 16 and a selection switch 18 are laid on the housing 12. Referring to FIG. 2, by means of switching the activation switch 15, a driving mechanism 20 disposed in the housing 12 is controlled to operate or stop. When the driving mechanism 20 operates, via a transmission assembly (a bevel gear assembly) 22, a rotary shaft 24 is driven to rotate. A grinding tool (not shown) is mounted at an outer end of the rotary shaft 24 for grinding a work piece. The rotary shaft 24 is formed with an axial passage 26.

Figure 3:
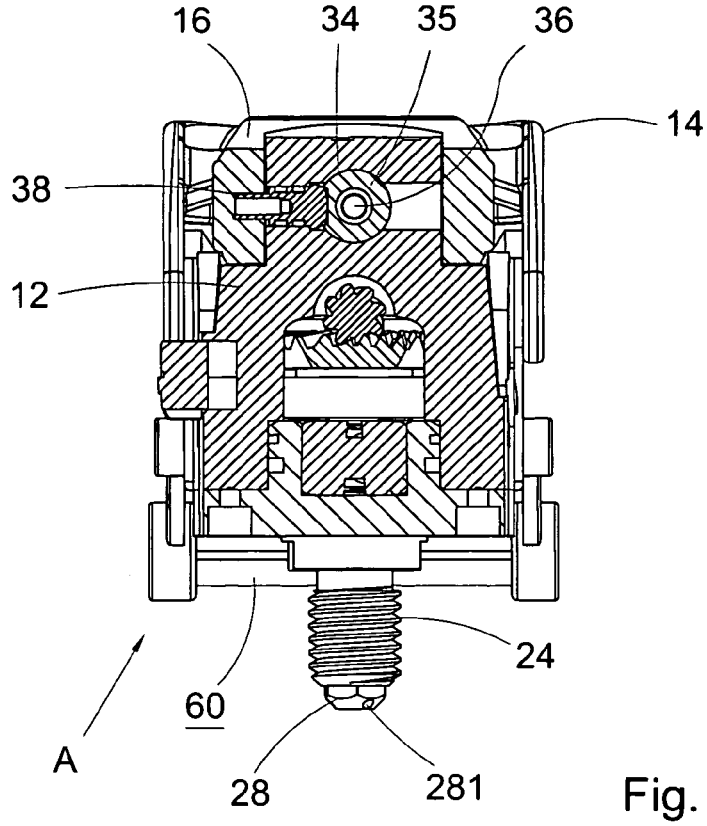
FIG. 3 is a sectional view taken along line 3-3 of FIG. 2.

The housing 12 is formed with an internal water incoming flow way 30. A rear end of the flow way 30 is connected to a connector 32 disposed at a rear end of the housing 12 for connecting with a water supply. A chamber 34 is formed in the housing 12 and connected with a front end of the flow way 30. A communicating hole 341 communicates the chamber 34 with a top end of the passage 26 of the rotary shaft 24. A water incoming ball valve 35 having a through hole 36 is disposed in the chamber 34 and connected with the water discharging switch 16 via a connecting rod 38 as shown in FIG. 3. By means of turning the water discharging switch 16, the through hole 36 of the ball valve 35 can communicate with the flow way 30 as shown in FIG. 2. At this time, the water can flow through the ball valve 35 and the water flow can be controlled. In the case that the through hole 36 of the ball valve 35 is not aligned with the flow way 30, the flow way 30 is blocked to interrupt the water flow.

A valve 40 is airtight disposed in the chamber 34 in front of the ball valve 35 corresponding to an inner end of the rotary shaft 24. The valve 40 has a valve rod 42 protruding out from the housing 12 and connected with the selection switch 18. When rotating the selection switch 18, the valve 40 is driven and rotated. A cavity 44 is formed at a rear end of the valve 40 in alignment with the water incoming ball valve 35. A conducting hole 46 is formed on a circumference of the valve 40 to communicate with the cavity 44. Referring to FIG. 2, by means of rotating the valve 40, the conducting hole 46 can communicate with the passage 26 of the rotary shaft 24.

Figure 4:
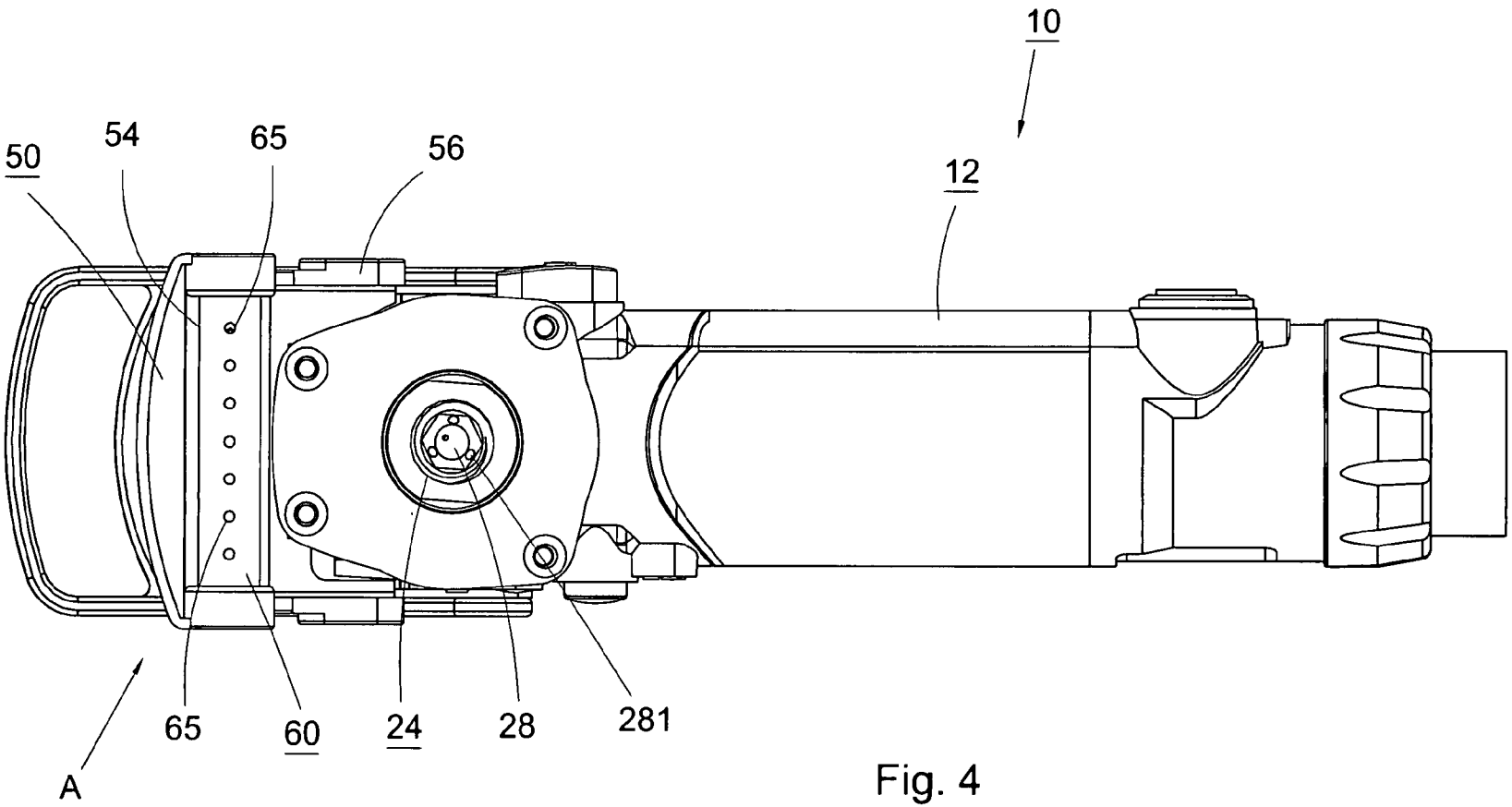
FIG. 4 is a bottom view according to FIG. 1.
Figure 5:
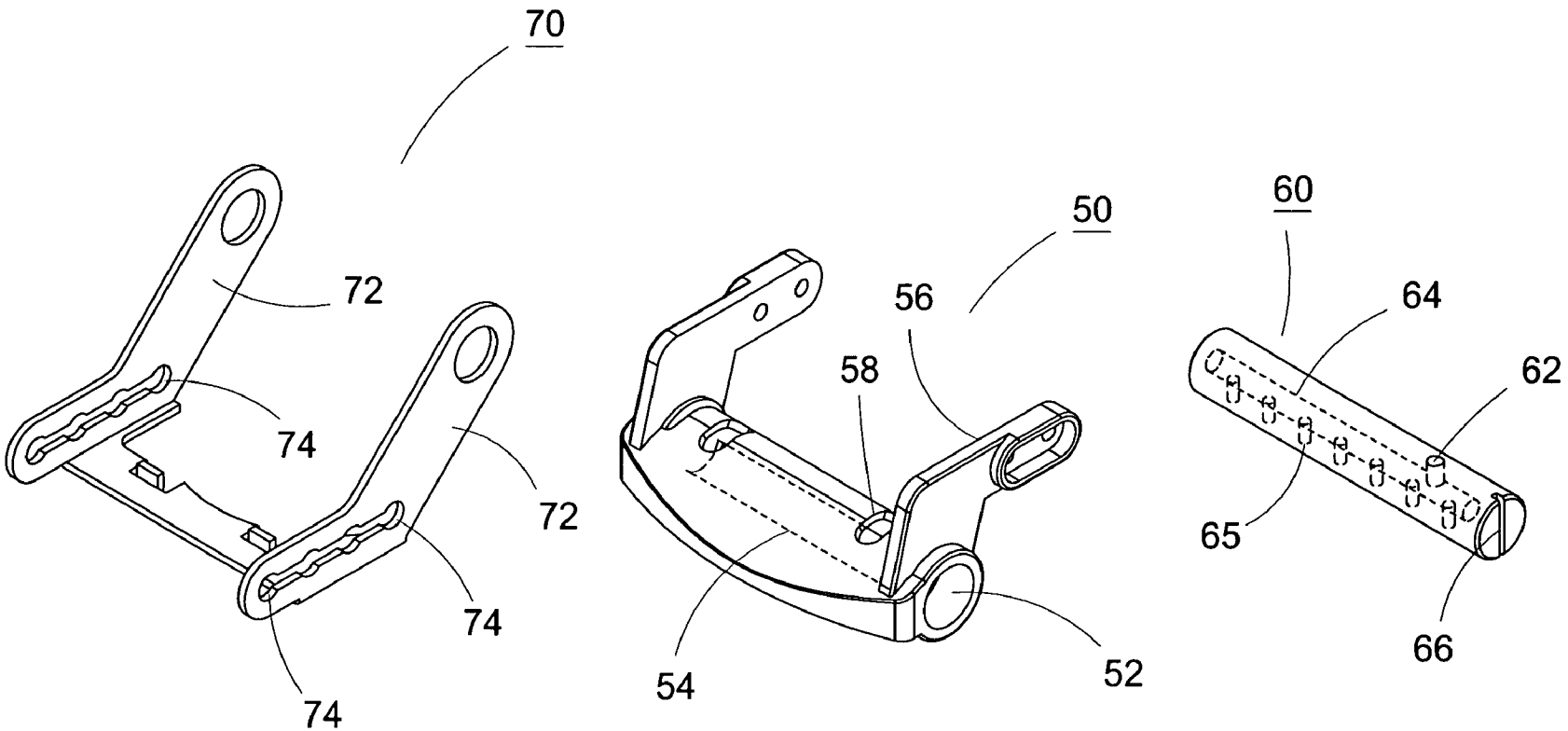
FIG. 5 is a perspective exploded view of the seat body, flow guide member and bracket of the first embodiment of the present invention.

An external water discharging assembly A is disposed at the front end of the housing 12. The external water discharging assembly A has multiple distributed water outlets 65 as shown in FIG. 4. Referring to FIG. 5, the water discharging assembly A is composed of a seat body 50 and a flow guide member 60. The seat body 50 is formed with an internal space 52 which is preferably a transverse hole. An opening 54 is formed on a bottom face of the seat body 50 to communicate with the space 52. The seat body 50 has two lugs 56 on two sides for connecting with the front end of the housing 12 as shown in FIG. 1. The flow guide member 60 is preferably a circular bar corresponding to the configuration of the space 52. The flow guide member 60 is hollow. A water inlet 62 is formed on a top face of the flow guide member. Said water outlets 65 are arranged on the bottom face of the flow guide member 60 at intervals to communicate with the water inlet 62 via the interior space 64 of the flow guide member. The flow guide member 60 is mounted in the space 52 of the seat body 50 as shown in FIG. 2, and is angularly displaceable within the seat body. The water outlets 65 are exposed to outer side of the bottom face of the grinder through the opening 54.

Figure 10:
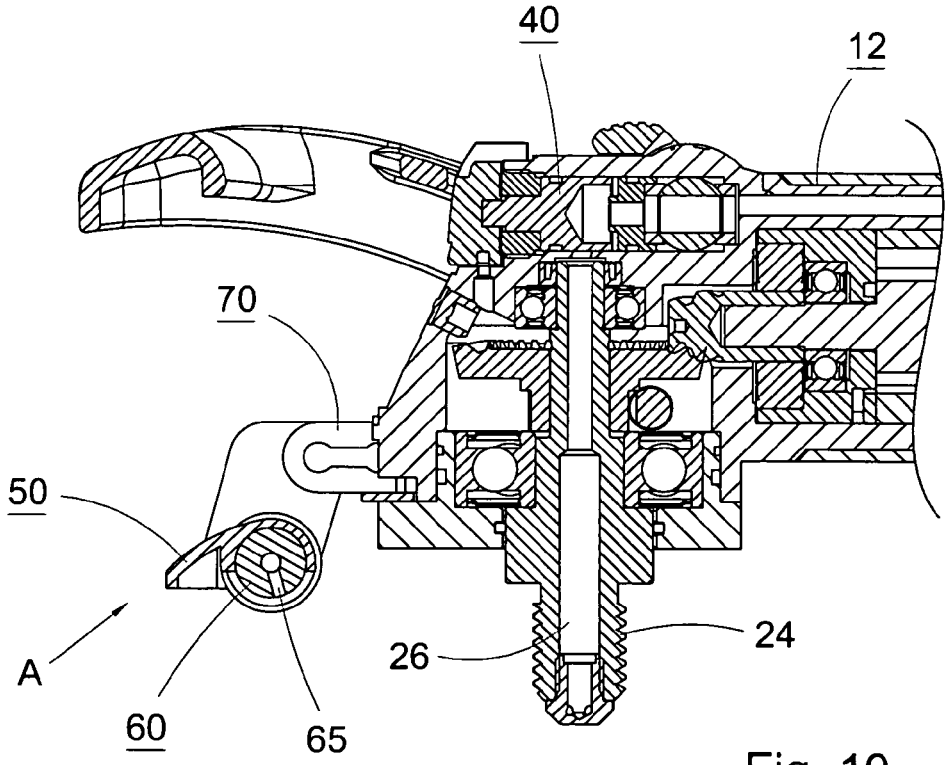
FIG. 10 is a sectional view showing that the external water discharging assembly is adjusted to different position and different water discharging angle.

The embodiment further includes a bracket 70 having two parallel arms 72. A front end of each arm 72 is formed with multiple mounting holes 74 arranged from front side to rear side. The rear ends of the arms 72 are fixedly connected with the housing 12. The lugs 56 of the seat body 50 are connected with the bracket 70 at the mounting hole 74 by means of screws (not shown). The seat body 50 can be closer to the housing as shown in FIG. 2 or farther from the housing as shown in FIG. 10 by means of connecting the seat body 50 with the bracket 70 at different mounting holes 74.

In practice, the lugs of the seat body or the housing can be formed with multiple mounting holes. This can also change the position of the seat body relative to the housing without using the bracket.

Figure 6:
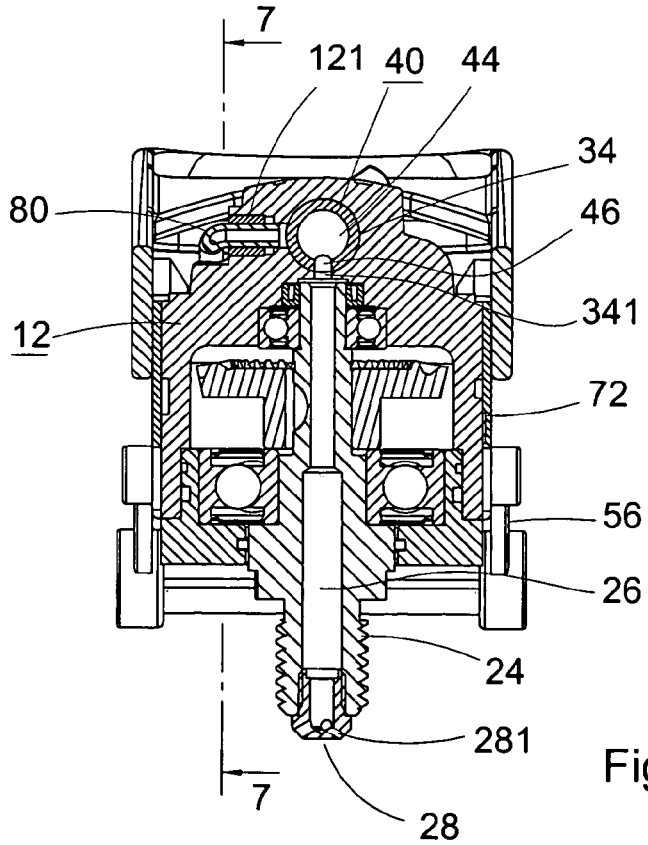
FIG. 6 is a sectional view taken along line 6-6 of FIG. 2.
Figure 7:
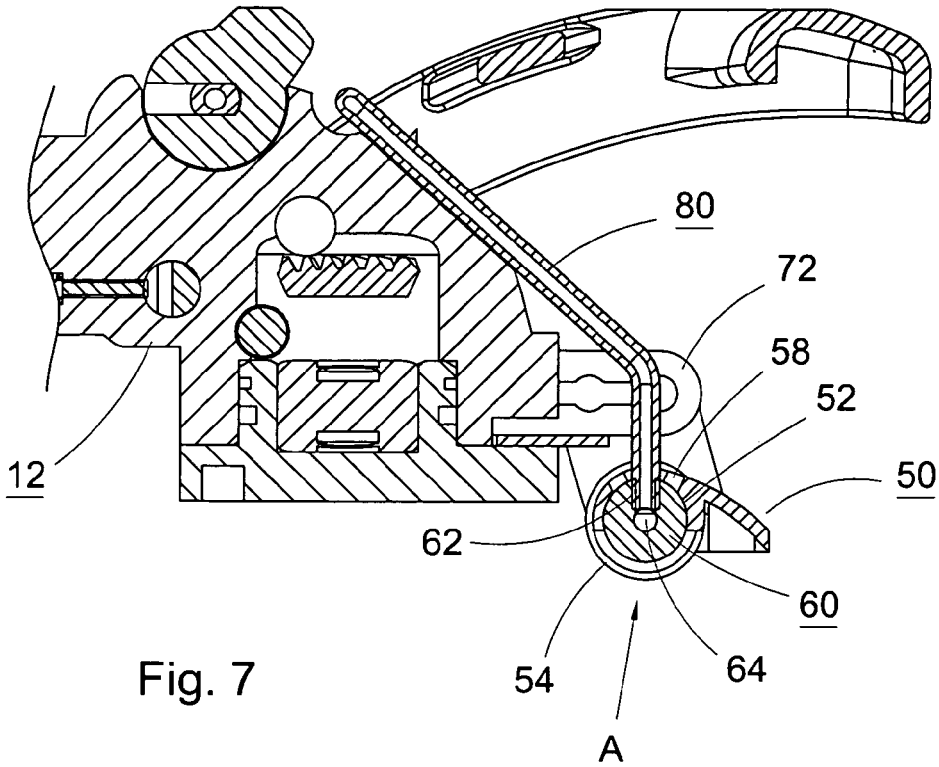
FIG. 7 is a sectional view taken along line 7-7 of FIG. 6.

A water flow bypass communicates the chamber 34 with the external water discharging assembly A. In this embodiment, a flexible conduit 80 serves as the water flow bypass. One end of the conduit 80 is airtight inserted in an insertion hole 121 formed on one side of the housing 12 to communicate with the chamber 34 corresponding to the valve 40 as shown in FIG. 6. The other end of the conduit 80 is passed through a hole 58 of the seat body 50 and inserted in the water inlet 62 of the flow guide member 60 as shown in FIG. 7.

In use, the water grinder 10 is connected to the water supply, whereby the water can flow into the water incoming flow way 30. By means of turning the water discharging switch 16, the through hole 36 of the ball valve 35 can be aligned with the flow way 30 to communicate therewith. At this time, the water can flow through the ball valve into the cavity 44 of the valve 40.

A user can turn the selection switch 18 to control the discharging position of the water. When the switch 18 is turned to a first position as shown in FIG. 1 (to indicate a figure a), the conducting hole 46 of the valve 40 is aligned with the passage 26 of the rotary shaft 24 as shown in FIG. 6. At this time, the water flows from the valve 40 into the passage 26 and then flows out from the outer end of the rotary shaft 24 as central discharged water. In this embodiment, a water discharging head 28 is screwed in the outer end of the rotary shaft. An outer end of the water discharging head is formed with three sprinkling holes 281 communicating with the interior of the water discharging head and the passage 26. Accordingly, the water can be sprinkled out from the sprinkling holes 281.

Figure 8:
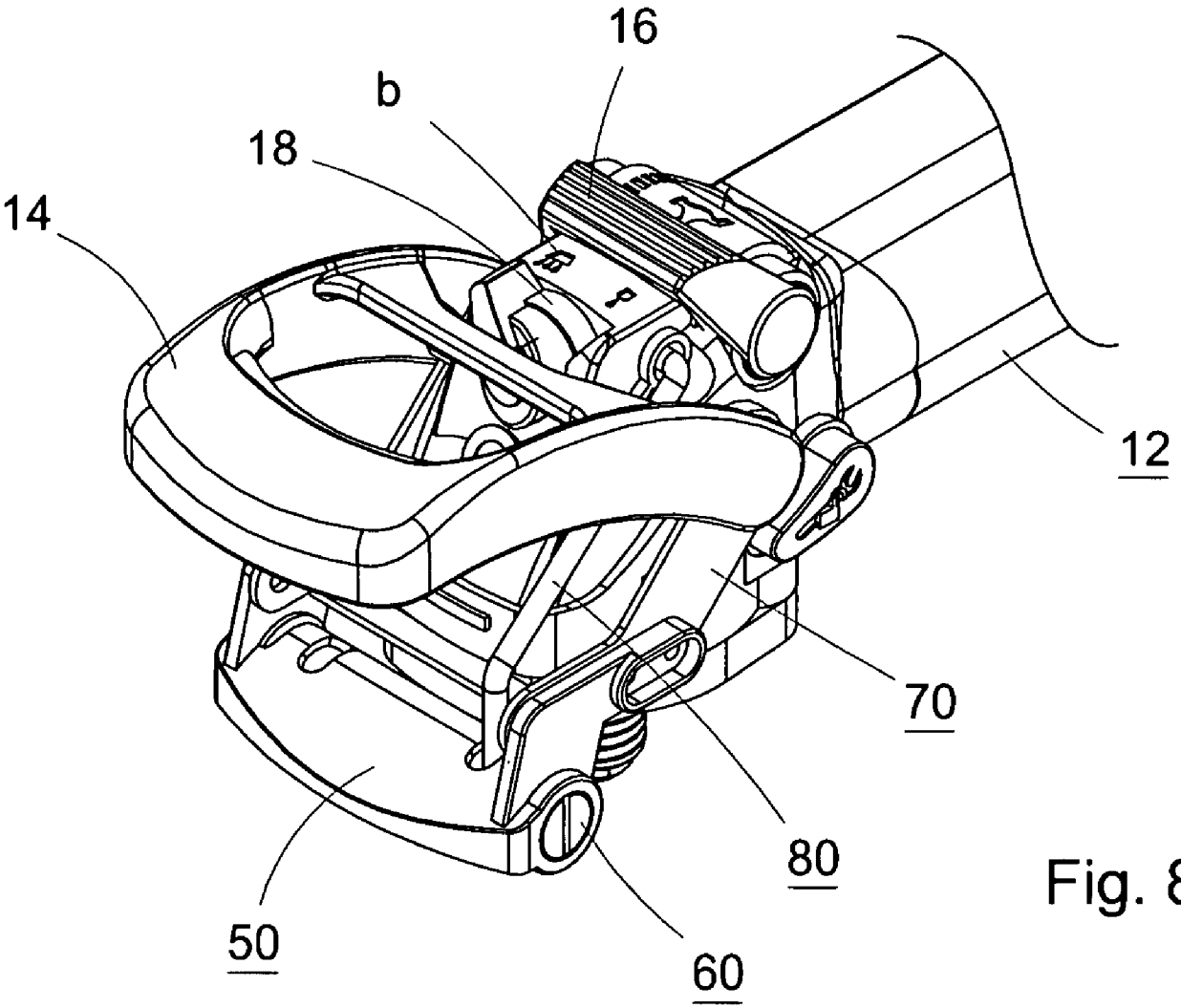
FIG. 8 shows that the selection switch is switched.
Figure 9:
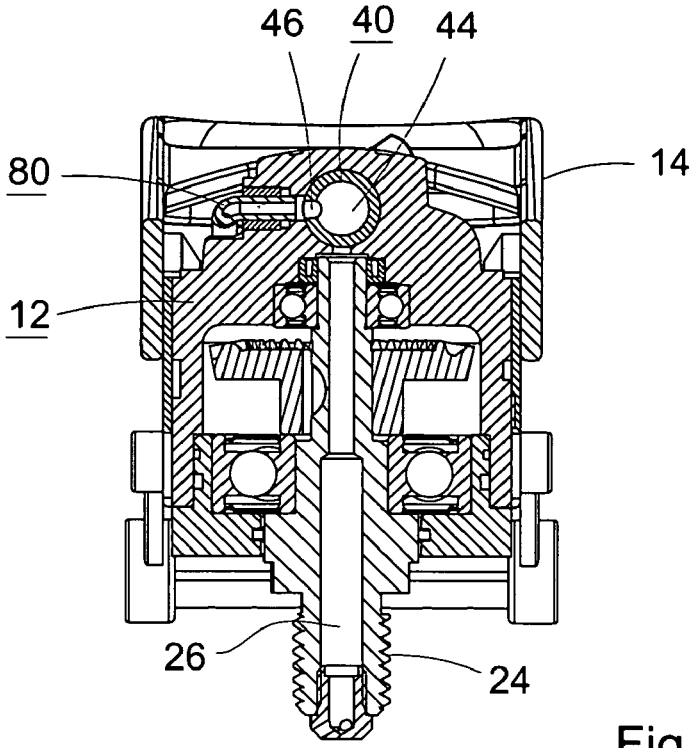
FIG. 9 is a sectional view showing that the valve communicates with the water flow bypass.

When the selection switch 18 is turned to a second position as shown in FIG. 8 (to indicate another figure b), the valve 40 is turned to a position as shown in FIG. 9. At this time, the conducting hole 46 is aligned with the water flow bypass 80. Under such circumstance, the water flows into the bypass 80 and then flows into the water inlet 62 of the flow guide member 60 and then discharges from the water outlets 65 as peripheral discharged water.

The position of the seat body 50 is changeable as aforementioned, whereby the water outlets 65 can be moved toward the housing 12 or away from the housing 12 so as to change the peripheral discharging position. In addition, a user can drive and turn the flow guide member 60 with a tool from a driving section 66 at one end of the flow guide member 60. Accordingly, the flow guide member 60 can be angularly displaced as shown in FIG. 10 to adjust the angle of the water outlets 65 and change the discharging direction.

Figure 11:
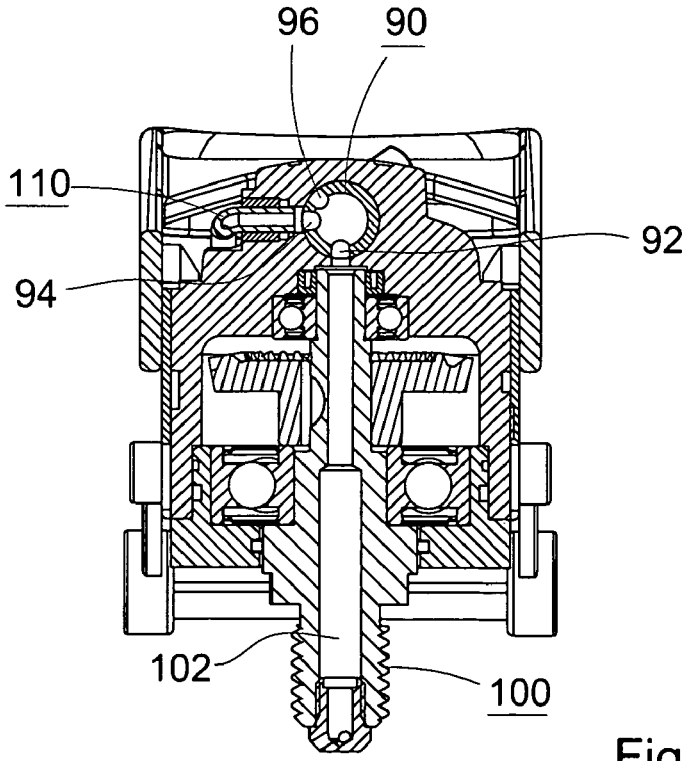
FIGS. 11 to 13 are sectional views of a second embodiment of the present invention, showing the operation positions thereof.
Figure 12:
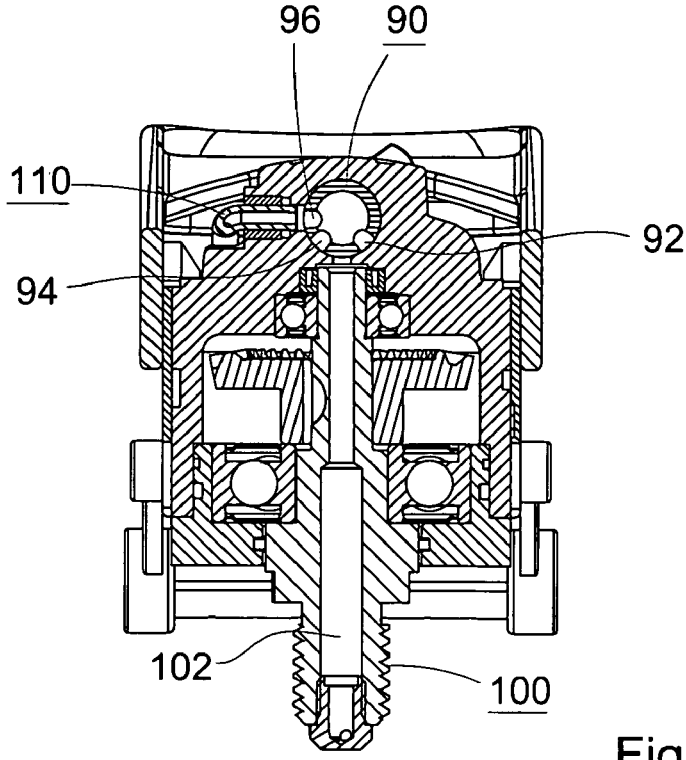
Figure 13:
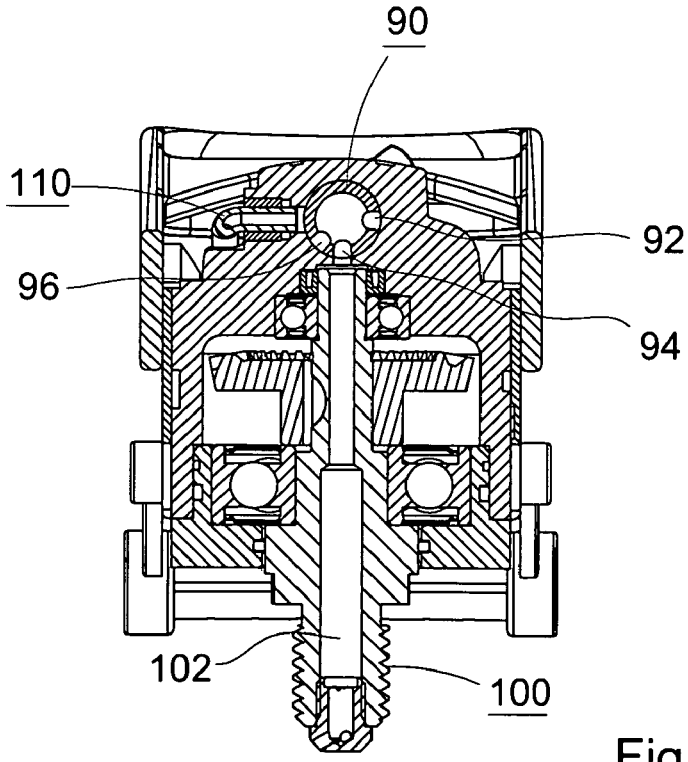

FIGS. 11 to 13 show a second embodiment of the present invention, in which the valve 90 is formed with three conducting holes 92, 94, 96. In the first position as shown in FIG. 11, the first conducting hole 92 and the second conducting hole 94 respectively communicate with the passage 102 of the rotary shaft 100 and the water flow bypass 110. At this time, the central discharged water and peripheral discharged water are both created. When the valve 90 is turned to the second position as shown in FIG. 12, only the third conducting hole 96 communicates with the water flow bypass 110 so that only the peripheral discharged water is created. When the valve 90 is turned to the third position as shown in FIG. 13, only the second conducting hole 94 communicates with the passage 102 of the rotary shaft so that only the central discharged water is created.

It should be noted that the valve can be alternatively formed with two conducting holes. When the valve is turned to a first position, one of the conducting holes communicates with the passage of the rotary shaft, while when the valve is turned to a second position, the other of the conducting holes communicates with the water flow bypass.

The water discharging position and angle of the water grinder of the present invention are adjustable (between central discharged water and peripheral discharged water). Accordingly, the powder dust can be best wetted. In addition, the water incoming structure is arranged inside the housing and protected from being collided and broken. Therefore, the problem of leakage of water can be obviated.

The above embodiments are only used to illustrate the present invention, not intended to limit the scope thereof. Many modifications of the above embodiments can be made without departing from the spirit of the present invention.

What is claimed is:

1. A water grinder comprising:

a housing in which a rotary shaft is drivably disposed, an outer end of the rotary shaft protruding out from the housing for mounting a grinding tool at the outer end, the rotary shaft being formed with an internal axial passage;

a water incoming flow way formed in the housing for the water to flow in, a chamber being formed in the housing and connected with a front end of the flow way, the chamber communicating with the passage of the rotary shaft;

a valve rotatably disposed in the chamber corresponding to an inner end of the rotary shaft, a cavity being formed at a rear end of the valve, the cavity communicating with the front end of the water incoming flow way, at least one conducting hole being formed on a circumference of the valve to communicate with the cavity;

a selection switch arranged on the circumference of the housing for a user to shift, the valve being connected with the selection switch, whereby when shifting the selection switch, the valve is driven and displaced;

an external water discharging assembly disposed at a front end of the housing, the external water discharging assembly having at least one water outlet; and a water flow bypass, one end of the water flow bypass communicating with the external water discharging assembly, while the other end of the water flow bypass communicating with the chamber;

whereby, by means of rotating the selection switch, the conducting hole of the valve being aligned with the passage of the rotary shaft or the water flow bypass, the water is discharged from the outer end of the rotary shaft or from the water outlet of the external water discharging assembly.

2. The water grinder as claimed in claim 1, wherein the external water discharging assembly is adjustably connected with the front end of the housing, whereby the distance between the water outlet and the housing is changeable, the water flow bypass being a flexible conduit, one end of the conduit being connected to the external water discharging assembly, while the other end of the conduit being connected with the housing.

3. The water grinder as claimed in claim 1, wherein the external water discharging assembly includes a seat body connected with the front end of the housing, a water inlet being formed on a top face of the seat body, the water outlet being arranged on the bottom face of the seat body, one end of the water flow bypass being connected to the water inlet.

4. The water grinder as claimed in claim 1, wherein the external water discharging assembly includes a seat body and a flow guide member, the seat body being formed with an internal space, an opening being formed on a bottom face of the seat body to communicate with the space, the seat body being connected with the front end of the housing, the flow guide member being a hollow member, a water inlet being formed on a top face of the flow guide member, the water outlet being arranged on the bottom face of the flow guide member to communicate with the water inlet, the flow guide member being mounted in the space of the seat body with the water outlet aligned with the opening, one end of the water flow bypass being connected to the water inlet.

5. The water grinder as claimed in claim 3, wherein the seat body is adjustably connected with the housing and the water flow bypass is a flexible conduit.

6. The water grinder as claimed in claim 4, wherein the seat body is adjustably connected with the housing and the water flow bypass is a flexible conduit.

7. The water grinder as claimed in claim 4, wherein the space of the seat body is a transverse hole and the flow guide member is a circular bar angularly displaceable within the space, the water flow bypass being a flexible conduit.

8. The water grinder as claimed in claim 7, further comprising a bracket, a rear end of the bracket being connected with the front end of the housing, the seat body being connected with a front end of the bracket.

9. The water grinder as claimed in claim 8, wherein the front end of bracket is formed with multiple mounting holes arranged from a front side to a rear side, the seat body being connected with the bracket at the mounting holes, whereby the seat body can be mounted at different mounting holes to change the distance between the seat body and the housing.

10. The water grinder as claimed in claim 9, wherein the bracket has two spaced arms, rear ends of the arms being connected with the housing, the mounting holes being respectively formed on front ends of the arms.

11. The water grinder as claimed in claim 1, further comprising a water incoming ball valve disposed in the chamber between the water incoming flow way and the rear end of the valve, a water discharging switch being arranged on a circumference of the housing for a user to shift, the water incoming ball valve being connected with the water discharging switch, whereby by means of shifting the water discharging switch, the ball valve is driven and rotated to block or unblock the flow way.

12. The water grinder as claimed in claim 1, wherein the valve is formed with at least two conducting holes, whereby when the valve is turned to different angular positions, the conducting holes respectively communicate with the passage of the rotary shaft or the water flow bypass.

13. The water grinder as claimed in claim 1, wherein a water discharging head is mounted at the outer end of the rotary shaft, an outer end of the water discharging head being formed with several sprinkling holes communicating with the passage of the rotary shaft.

14. A water grinder comprising:

a housing in which a rotary shaft is drivably disposed, an outer end of the rotary shaft protruding out from the housing for mounting a grinding tool at the outer end, the rotary shaft being formed with an internal axial passage;

a water incoming flow way formed in the housing for the water to flow in, a chamber being formed in the housing and connected with a front end of the flow way;

a water incoming ball valve disposed in the housing between the chamber and the water incoming flow way, the ball valve having a through hole;

a water discharging switch arranged on a circumference of the housing and connected with the water incoming ball valve, whereby by means of shifting the water discharging switch, the ball valve is driven and rotated to make the through hole of the ball valve communicate with the flow way or not communicate with the flow way so as to block or unblock the flow way; and at least one water outlet formed at the front end of the water grinder and communicating with the chamber, whereby after the water flows into the water incoming flow way, the water flows through the ball valve to discharge from the water outlet.

15. The water grinder as claimed in claim 14, wherein the rotary shaft is formed with an internal axial passage, a communicating hole being formed in the housing to communicate the chamber with an inner end of the passage of the rotary shaft, an outer end of the passage serving as the water outlet.

16. The water grinder as claimed in claim 14, wherein the water outlet is disposed at the front end of the housing.

17. The water grinder as claimed in claim 14, wherein an external water discharging assembly is disposed at a front end of the housing, the water outlet is disposed at the external water discharging assembly.

* * * * *